United States Patent [19]

Howlett

[11] Patent Number: 4,842,495

[45] Date of Patent: Jun. 27, 1989

[54] NON THROTTLING DISCHARGE PUMP ASSEMBLY

[75] Inventor: David J. Howlett, King's Lynn, United Kingdom

[73] Assignee: Bespak Plc, Norfolk, United Kingdom

[21] Appl. No.: 111,548

[22] Filed: Oct. 23, 1987

[30] Foreign Application Priority Data

Oct. 24, 1986 [GB] United Kingdom ..... 8625491

[51] Int. Cl.[4] ..... F04B 13/00

[52] U.S. Cl. ..... 417/488; 417/328; 417/489; 417/547; 222/321

[58] Field of Search ..... 417/471, 486–488, 417/489, 495, 547, 550, 328, 566; 222/321, 385

[56] References Cited

U.S. PATENT DOCUMENTS

| | | | |
|---|---|---|---|
| 4,147,476 | 4/1979 | Warren | 417/328 |
| 4,189,064 | 2/1980 | O'Neill et al. | 222/321 |
| 4,503,997 | 3/1985 | Corsette | 222/321 |
| 4,692,103 | 9/1987 | Anderson | 417/547 |
| 4,693,675 | 9/1987 | Venus, Jr. | 417/489 |

*Primary Examiner*—Carlton R. Croyle
*Assistant Examiner*—Eugene L. Szczecina, Jr.
*Attorney, Agent, or Firm*—Beveridge, DeGrandi & Weilacher

[57] ABSTRACT

A pump assembly (1) for an atomizing piston pump comprising a piston (16) slidably located in a cylinder (4), a variable volume fluid storage chamber (5) in communication with the cylinder on one side of the piston, means (18) for varying the volume of the chamber, resilient means (17) urging the varying means into a position corresponding to the minimum volume of the chamber, a fluid flow passageway (30, 31) through the piston, a resilient valve member (25) normally closing the passageway and deforming means (23) for deforming the valve member so as to open the passageway only after the piston has moved relative to the cylinder by a predetermined amount greater than zero. The pump assembly has application to dispensing metered doses of medicinal products and ensures that the dispensed dose is independent of finger pressure applied to the actuator.

12 Claims, 11 Drawing Sheets

NON THROTTLING DISCHARGE PUMP ASSEMBLY

Figure 1:
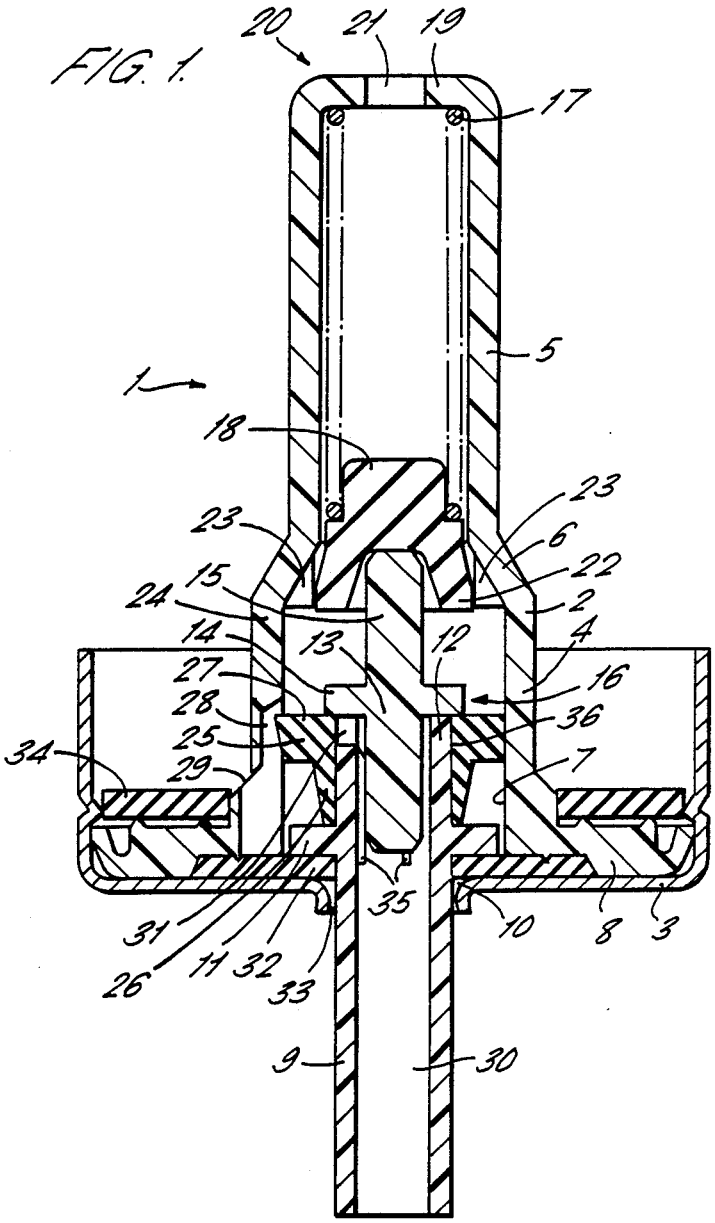

This invention relates to a pump assembly for an atomising piston pump.

It is known to provide such a pump assembly comprising a piston slidably located in a cylinder, a variable volume fluid storage chamber in communication with the cylinder on one side of the piston, means for varying the volume of the chamber, resilient means urging the varying means into a position corresponding to the minimum volume of the chamber, a fluid flow passageway through the piston, valve means for opening and closing the passageway and means for opening the valve means only after the piston has moved relatively to the cylinder by a predetermined amount greater than zero. This type of pump assembly is known for example from United Kingdom Patent 1499325.

Such pump assemblies are referred to as being of the non throttling type since the flow of fluid during discharge is independent of any bias applied to the piston by the operator of the pump whereas in so called throttling type of pump assembly the flow may be varied by a throttling action dependent upon the bias applied to the piston by finger pressure for example.

According to the present invention there is disclosed a pump assembly for an atomising piston pump comprising a piston slidably located in a cylinder, a variable volume fluid storage chamber in communication with the cylinder on one side of the piston, means for varying the volume of the chamber, resilient means urging the varying means into a position corresponding to the minimum volume of the chamber, a fluid flow passageway through the piston, a resilient valve member normally closing the passageway and deforming means for deforming the valve member so as to open the passageway only after the piston has moved relative to the cylinder by a predetermined amount greater than zero.

An advantage of such an arrangement is that the need for a complex multicomponent valve means including a spring biassing the valve means into the closed position is obviated.

Preferably the piston includes a cylindrical surface in which an aperture of the passageway is formed and the resilient valve member includes a sleeve portion which overlays the surface and normally obturates the aperture, which sleeve portion is axially compressible by the deforming means so as to at least partially uncover the aperture and thereby open the passageway.

Preferably the resilient valve member is mounted coaxially upon and moveably with the piston and further comprises a piston ring portion of larger radius than the sleeve portion, which piston ring portion forms a seal between the piston and the cylinder throughout at least part of the piston stroke.

In a preferred embodiment of the invention the piston ring portion is located at or adjacent to a first axial extremity of the sleeve portion, the valve member being orientated such that a second axial extremity of the sleeve portion precedes the first extremity during the compression stroke of the piston into the cylinder.

An advantage of such an arrangement is that the valve member performs a dual function of sealing the piston to the cylinder and providing valve action to open and close the passageway. The complexity and number of components is thereby further reduced.

Advantageously the cylinder has a first end adjacent the piston in its position of rest between operating periods of the pump assembly and a second end adjacent the piston in its position of maximum travel during operation of the pump assembly and the cylinder is open at both first and second ends for filling with fluid whilst the piston is in its rest position.

The pump assembly may therefore be self priming since gas may escape from one end of the cylinder whilst liquid fills through the other end by gravity filling for example.

Conveniently where the pump assembly includes a valve member having a piston ring portion the cylinder further includes a bypass channel at the first end which provides a flow path bypassing the seal provided by the piston ring portion when the piston is in its rest position whereby the cylinder is then open at its first end.

Alternatively the pump assembly may have a valve member wherein the piston ring portion provides a seal between the piston and the cylinder throughout the stroke of the piston and the cylinder is open at its second end for filling with fluid when the piston is in its rest position between operating periods of the pump assembly.

Such an arrangement will not however be self priming and fluid will fill the cylinder by suction action when the piston returns to its rest position.

This type of arrangement could be used for example in providing a pump assembly for a vented container (i.e. open to atmospheric pressure) so that in use the container remained upright with the stem of the pump assembly uppermost.

Conveniently the deforming means comprises abutment means extending inwardly of the cylinder and engageable in abutment with the valve member when the piston has moved by the predetermined amount such that continued movement of the piston deforms a valve member.

Conveniently the abutment means comprises an annular insert located in the cylinder so as to provide a radially inwardly directed projection for abutment with the valve member.

Alternatively the piston comprises an elongate body portion having a front end extending into the cylinder and a projecting portion which is connected coaxially therewith to the front end by means of the valve member so as to be longitudinally moveable relative to the body portion by deformation of the valve member, the cylinder having at its second end an abutment means engageable in abutment with the projecting portion when the piston has moved relative to the cylinder by the predetermined amount, which abutment means and projecting portion together constitute the valve member deforming means.

Conveniently the body portion in such an arrangement is tubular and the projecting portion is tubular having a closed end adjacent to and nestable within the body portion, the projecting portion having a radially extending port having an aperture in its outer cylindrical surface which is normally closed by the valve member and opened by action of the deformation means to deform the valve member, the arrangement being such that when the aperture is open the projection portion, the port and the body portion define an open passageway through the piston and when the aperture is closed the passageway is closed by the valve member.

Figure 2:
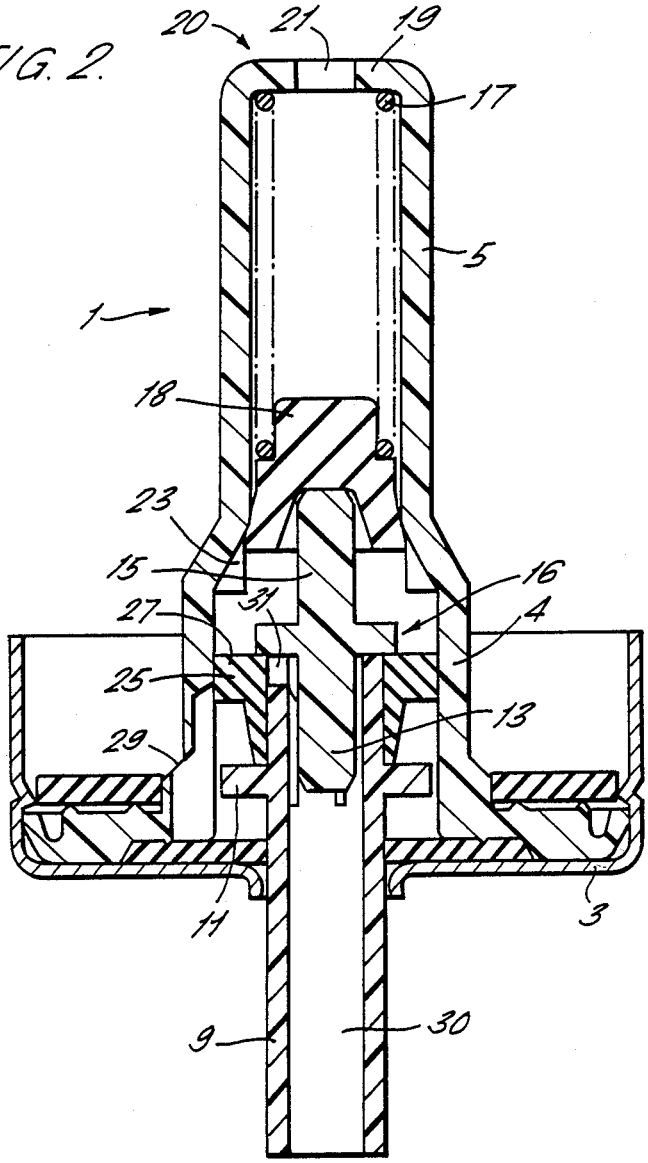
Figure 3:
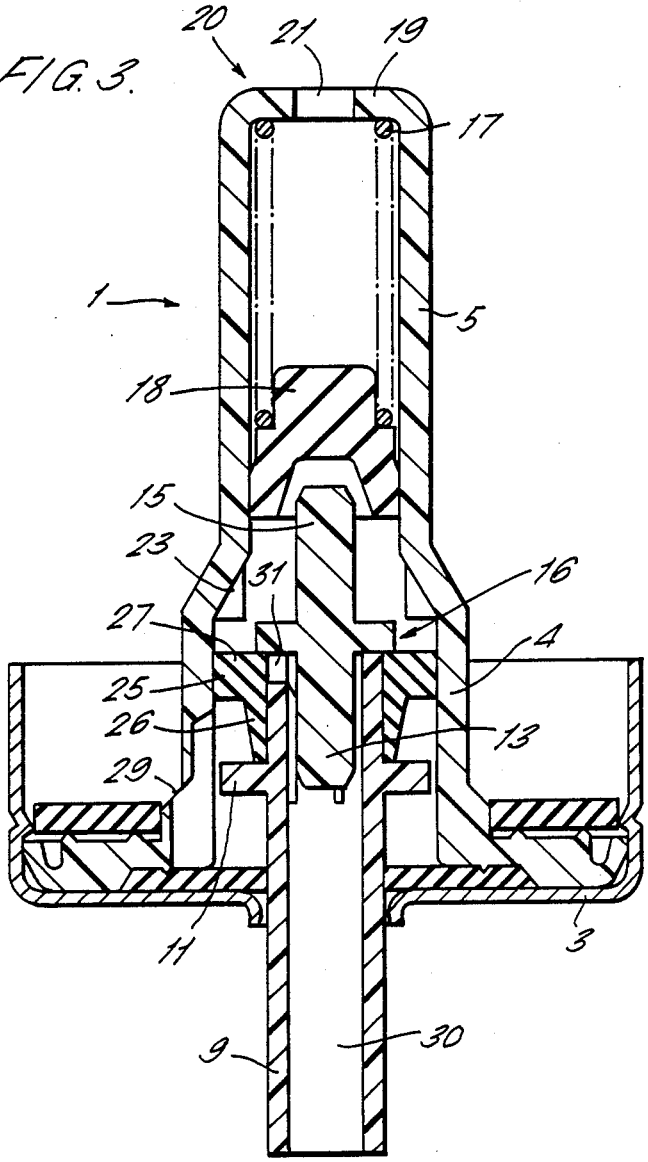
Figure 4:
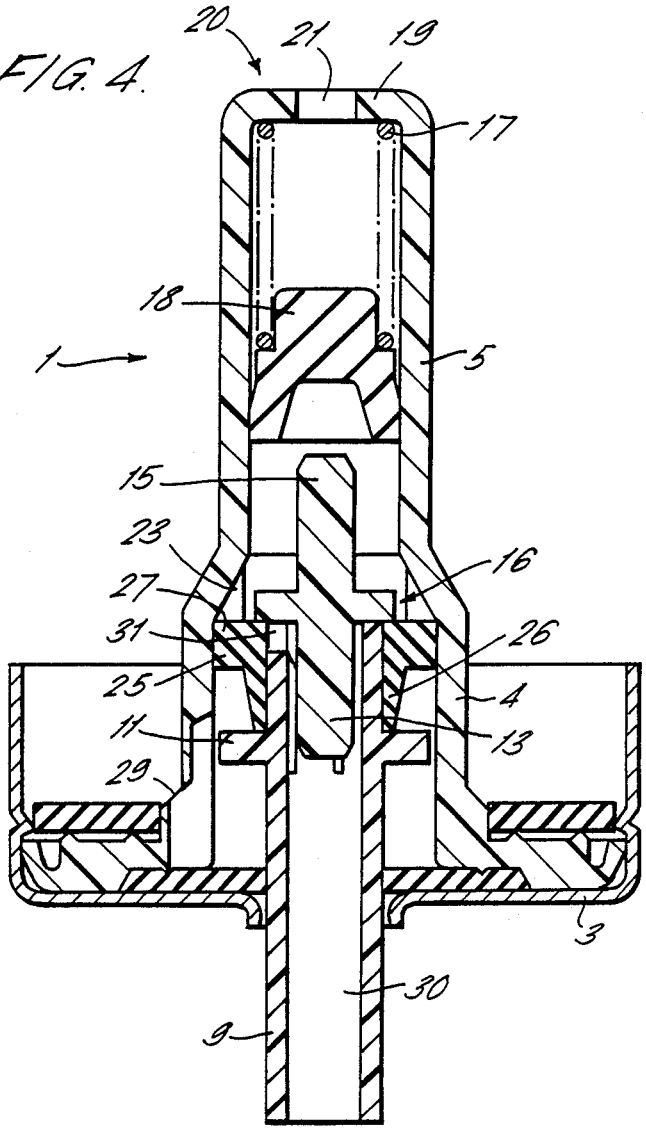
Figure 5:
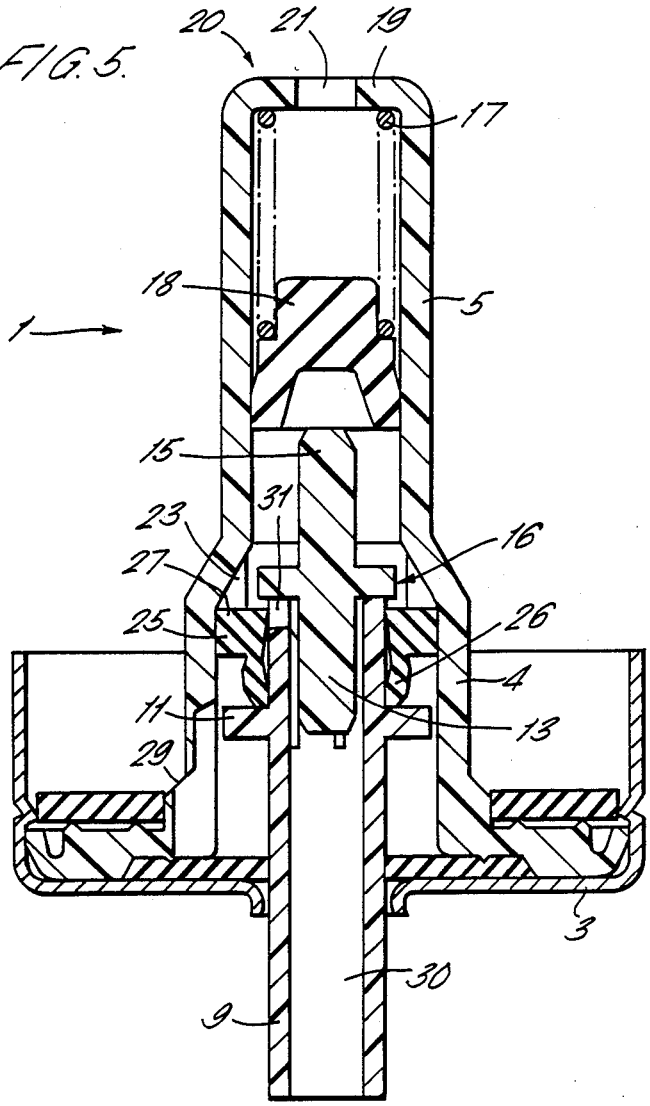
Figure 6:
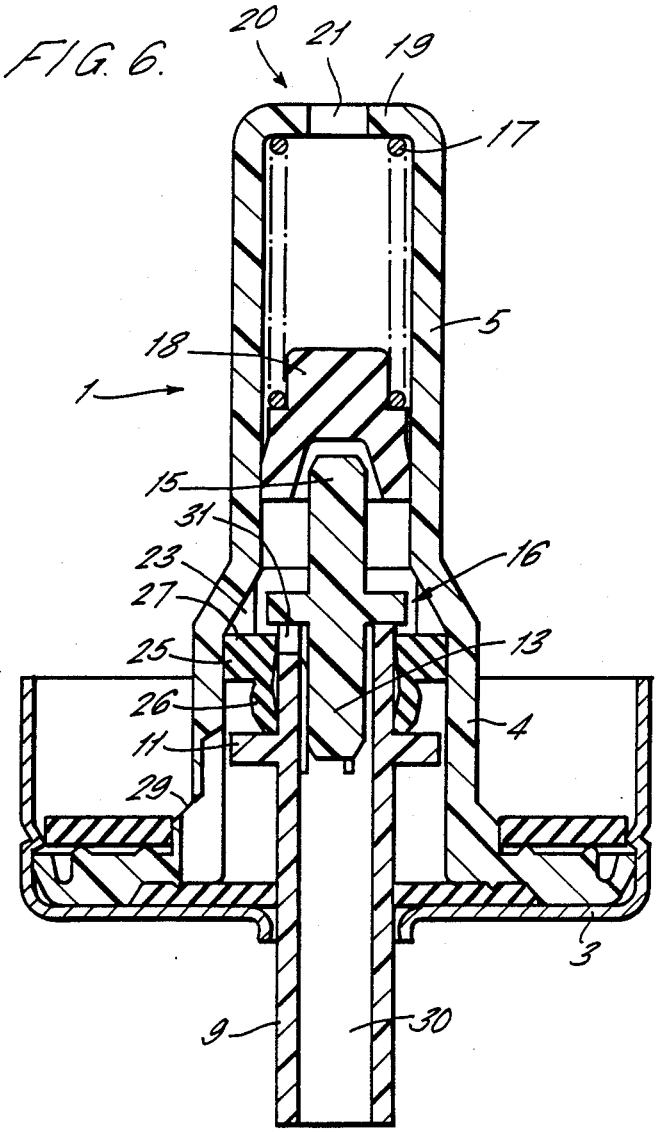
Figure 7:
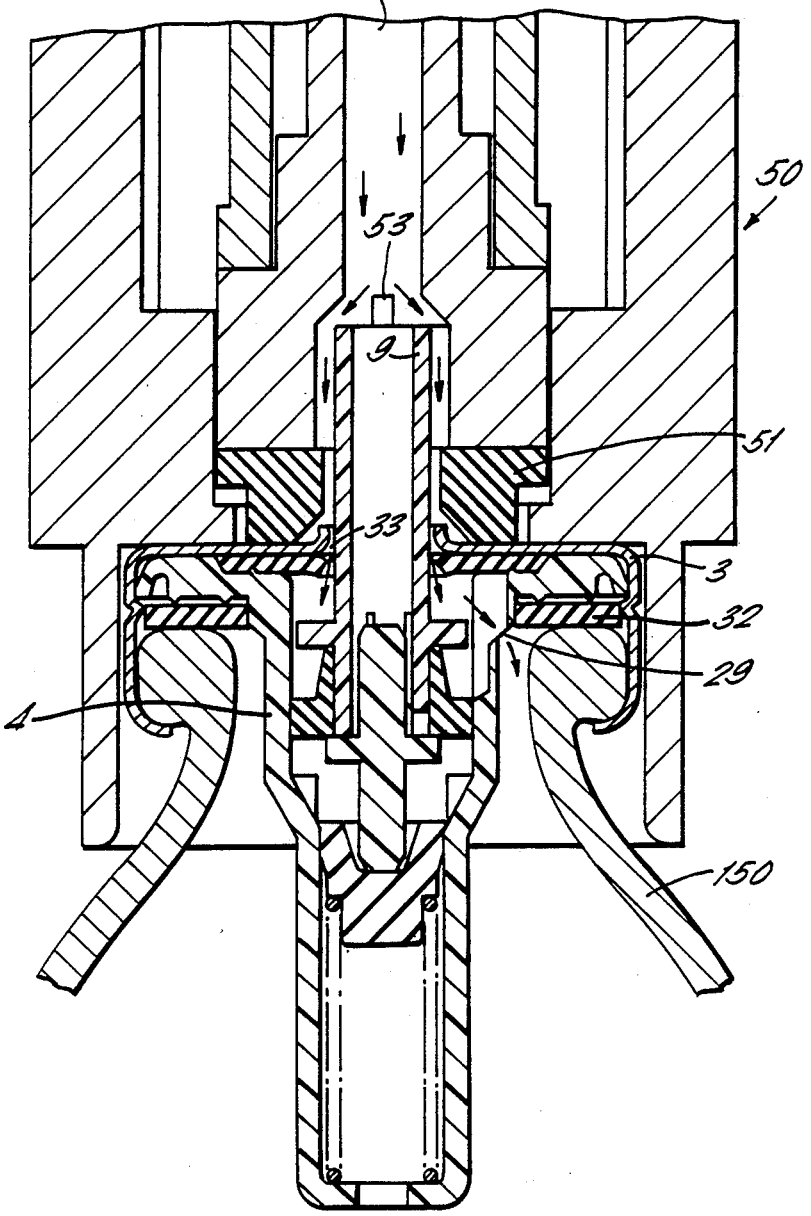
Figure 8:
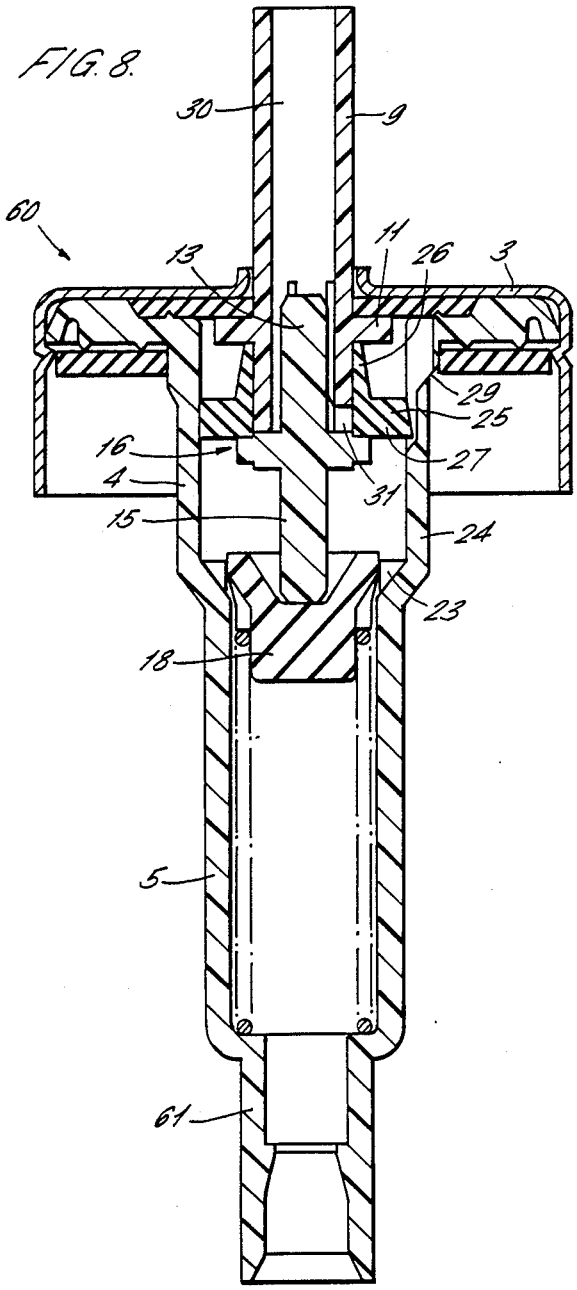
Figure 10:
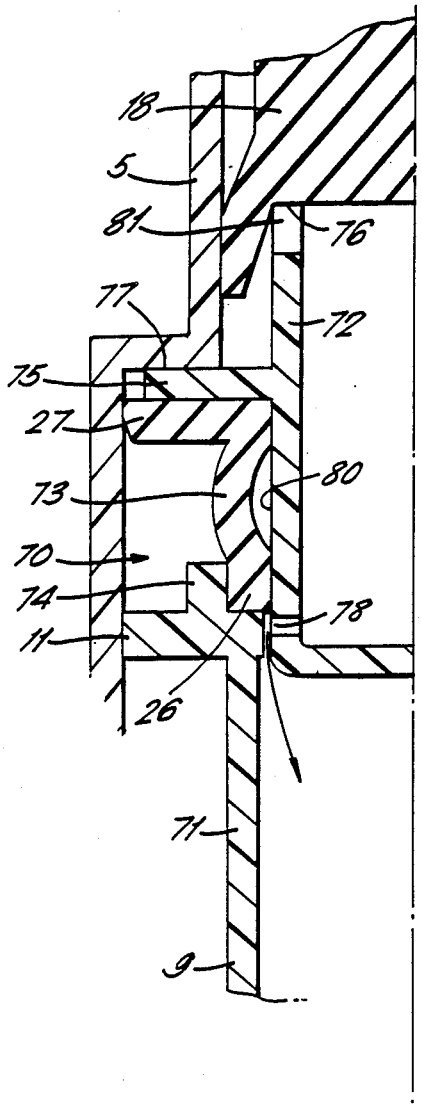
Figure 9:
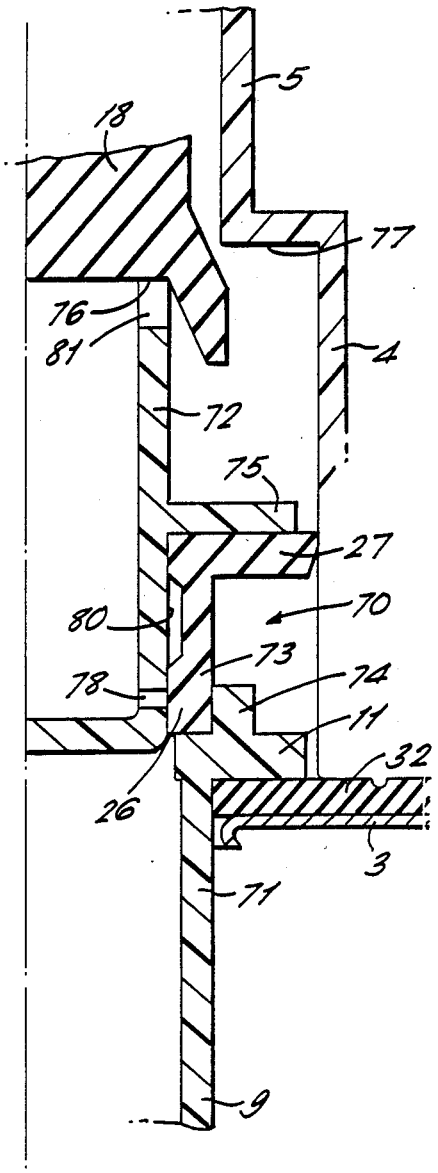
Figure 11:
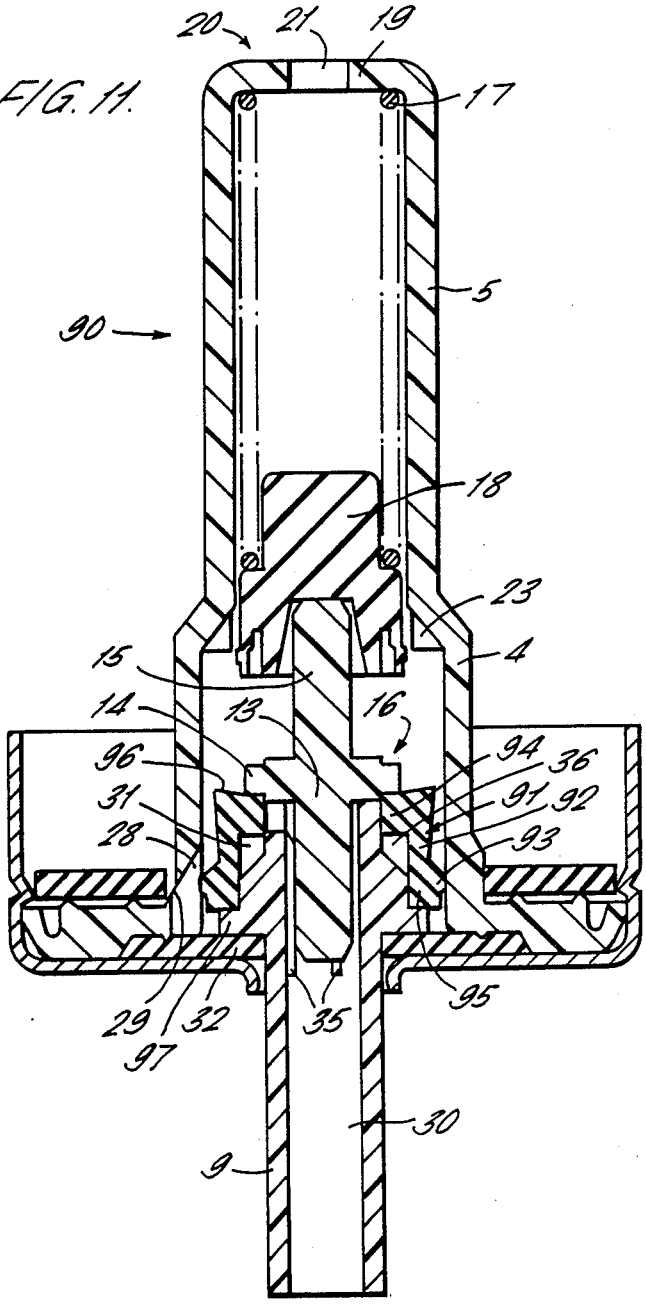
Figure 12:
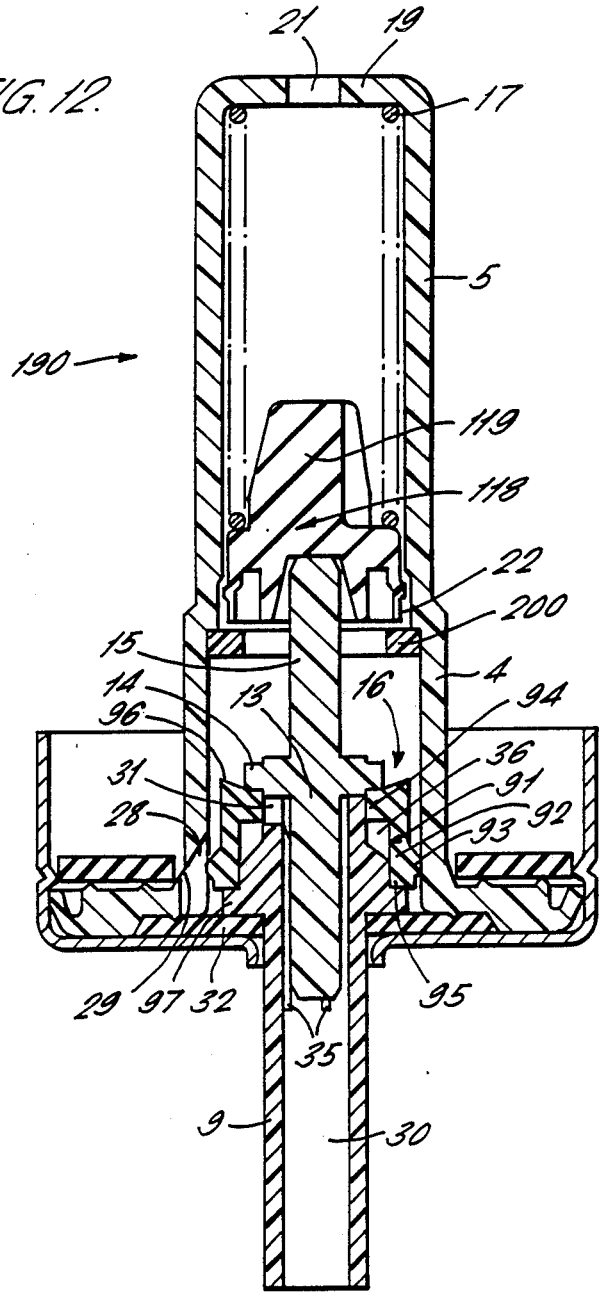

Particular embodiments of the present invention will now be disclosed by way of example only and with reference to the accompanying drawings of which:

FIG. 1 is a sectional elevation of a pump assembly with the piston in its rest position, FIG. 2 is a similar view of the assembly of FIG. 1 with the piston partially depressed such that the valve member seals between the piston and cylinder, FIG. 3 is a similar view after further depression of the piston in which fluid is forced into the chamber, FIG. 4 is a similar view after still further depression of the piston when the valve member first abuts the deforming means, FIG. 5 is a similar view with the piston fully depressed such that the valve member is deformed to open the passageway, FIG. 6 is a similar view during discharge of the product by action of the resilient means to reduce the volume within the chamber, FIG. 7 is a sectional elevation of the pump assembly fitted to a container during filling from a filling head, FIG. 8 is a sectional elevation of an alternative embodiment of a pump assembly adapted for upright use, FIG. 9 is a sectional view of part of a further alternative embodiment of a pump assembly in which the piston comprises two relatively moveable components, FIG. 10 is a similar view of the pump assembly of FIG. 9 showing the valve member in its deformed state, FIG. 11 is a sectional elevation of an alternative pump assembly having a modified valve member, and FIG. 12 is a similar view of an alternative pump assembly having an annular insert constituting the abutment means.

FIG. 1 shows a pump assembly 1 comprising a housing 2 of a plastics material to which a metallic cup 3 is attached by crimping. The housing 2 comprises a cylinder 4 and a secondary cylinder 5 of smaller diameter which is connected contiguously and coaxially with the cylinder 4 by a tapered neck 6.

The housing 2 is externally enlarged adjacent a first end 7 of the cylinder 4 to provide an annular base 8 upon which the cup 3 is mounted.

A tubular stem 9 extends through a central orifice 10 in both the cup 3 and the base 8 so as to extend into the cylinder 4 and is retained by an annular flange 11 of larger radius than the orifice 10. The stem 9 has an innermost end 12 with respect to the cylinder 4 within which circumferentially spaced axially extending ribs 35 project radially inwards of the inner surface. A cylindrical member 13 extends axially into the innermost end 12 to an extent limited by an annular stop 14 projecting from the member at its mid point so that a projecting portion 15 of the member extends into the cylinder 4. The member 13 is frictionally retained within the innermost end 12 of the stem 9 by contact with the ribs 35.

The stem 9 and the cylindrical member 13 together comprise a piston 16 which is axially slidable within the cylinder 4.

The secondary cylinder 5 houses a helical compression spring 17 which biasses a secondary piston 18 towards the neck 6 by reaction of the spring against a seat 19 at the remote end 20 of the secondary cylinder. The secondary cylinder 5 and the secondary piston 18 together comprise a variable volume storage chamber which is shown in FIG. 1 in its condition of having a minimum (zero) volume forward of the secondary piston 18.

A port 21 is provided in the seat 19 for the admission of fluid rearward of the secondary piston 18. The secondary piston 18 includes a deformable annular outer collar 22 at its forward end which seals the secondary piston against the secondary cylinder 5 during forward motion of the secondary piston. The outer collar 22 is frusto conically profiled so as to taper in a direction away from the cylinder 4.

As shown in FIG. 1 the piston 16 is in its rest position adjacent the first end of the cylinder 4 with the spring 17 being fully extended so that the secondary piston 18 is held in contact with the projecting portion 15. In this position the outer collar 22 of the secondary piston 18 is external to the secondary cylinder 5 and is spaced from the neck 6 by webs 23 which extend longitudinally of and radially inward of the housing 2 at the second end 24 of the cylinder 4. A fluid pathway into the cylinder 4 then exists through the port 21, the interior of the secondary cylinder 5, between the webs 23 and into the cylinder 4 at its second end 24.

A resilient valve member 25 is mounted coaxially upon the stem 9 within the cylinder 4 so as to be captively retained axially between the flange 11 and the stop 14. The valve member 25 comprises a sleeve portion 26 having at one end a radially extending piston ring portion 27 adjacent the stop 14. The piston ring portion 27 forms a seal between the piston 16 and the cylinder 4 which in the rest position as shown in FIG. 1 is bypassed by an axially extending groove 28 on one side of the cylinder wall so as to form a bypass channel communicating with a vent 29 extending through the housing 2.

In the rest position as shown in FIG. 1 a further fluid flow path is established into the cylinder 4 through the vent 29 and the groove 28 so that the cylinder is in effect open at both ends.

The stem 9 includes an axially extending passageway 30 communicating with an aperture 31 formed in the outer cylindrical surface 36 of the stem 9 at its innermost end 12 with respect to the chamber 4. The ribs 35 serve to space the cylindrical member 13 from the internal wall of the stem 9 so that the passageway 30 is not blocked by this member. In the rest position as shown in FIG. 1 the aperture 31 is closed by the valve member 25 so that there is no communication through the passageway 30 into the cylinder 4.

A sealing gasket 32 surrounds the stem 9 at its point of entry to the cup 3 so as to provide a fluid tight seal and the stem 9 is a loose fit within the orifice 10 in the cup 3 such that an annular gap 33 is defined therebetween. The gasket 32 is periferally clamped between the outer side of the base 8 and the inner side of the cup 3.

A further seal 34 is provided on the opposite side of the base 8 and external to the cylinder 4 so that in attaching the cup 3 to the lip of a container (not shown) the further seal 34 provides a fluid tight seal between the lip and the base.

The pump assembly 1 is shown in FIG. 1 in an inverted position in which the stem 9 is downwardly directed in readiness for dispensing of a liquid product contained in the container (not shown). In this inverted position liquid from the container enters the cylinder 4 through the vent 29 and groove 28 whilst any trapped gas within the cylinder 4 is vented upwardly through the second end 24 of the cylinder 4 to emerge from the port 21. The pump assembly is therefore self priming simply by placing the container and pump assembly in the inverted position as shown in FIG. 1.

The function of the pump assembly is illustrated in subsequent FIGS. 2 to 6. In FIG. 2 the stem is partially depressed such that the piston 16 extends further into the cylinder 4. The valve member 25 is seen to have passed beyond the axially extent of the groove 28 so that the seal formed between the piston 16 and the cylinder 4 is complete and no longer bypassed. At the same time the depression of the stem 9 raises the projecting portion 9 of the member 13 such that the secondary piston 18 is raised so as to enter the secondary cylinder 5 against the action of the spring 17. The deformable outer collar 22 is then able to seal against the secondary cylinder 5 and a closed volume of fluid is then contained in the cylinder 4 between the piston 16 and the secondary piston 18.

Under continued depression of the stem 9 as shown in FIG. 3 the piston 16 travels further into the cylinder 4 and because the contained volume of fluid is substantially incompressible the reduced cross sectional area of the secondary cylinder 5 results in the secondary piston 18 travelling by a greater amount than the piston 16. In this condition the secondary cylinder and the secondary piston 18 together comprise a fluid storage chamber which increases in volume as the secondary piston continues its travel.

Continued depression of the stem 9 moves the piston 16 to a predetermined position in which the valve member 25 abuts against the webs 23 at the second end of the cylinder 4. The piston 16 has now moved by a predetermined amount such that a volume of fluid has been displaced from the cylinder 4 into the storage chamber comprising the secondary cylinder 5 and secondary piston 18. The fluid within the cylinder 4 and the storage chamber is also pressurised by spring action and this excess pressure urges the outer collar 22 into positive sealing engagement with the secondary cylinder 5.

Continued depression of the stem as shown in FIG. 5 results in compression of the valve member 25 between the flange 11 and the webs 23 such that the valve member becomes shorter in length. This deformation is accommodated by a bulging of the sleeve portion 26 as the piston ring portion 27 moves towards the flange 11. The aperture 31 is exposed by this deformation thereby opening the passagway 30 such that a fluid pathway is established for the escape of pressurised fluid from the cylinder 4 through the aperture 31 and through the passagway 30. The fluid is expelled via the passageway 30 by action of the secondary piston 18 which is now able to travel downwards under bias from the spring 17 as the fluid pressure forward of the piston is relieved. The travel of the secondary piston 18 is limited by its coming into contact with the projecting portion 15 of the piston 16 so that the volume of fluid dispensed is determined by the dimensions of the secondary cylinder 5 and the distance travelled by the secondary piston 18 during discharge.

When the stem 9 is released after being depressed (typically by finger pressure) the stem 9 travels downwards under action of the spring 17 with the secondary piston 18 bearing upon the piston 16 until the flange 11 engages the sealing gasket 32 so as to arrest the motion. The piston 16 is again in its rest position as shown in FIG. 1 and the cylinder 4 again fills with fluid ready for reuse of the pump assembly.

FIG. 7 shows the manner in which the pump assembly 1 of FIGS. 1 to 6 enables the container 150 to which the pump assembly is connected to be filled after assembly with the pump assembly 1. A filling head 50 is shown in engagement with the pump assembly 1 which has been inverted with respect to its position shown in FIGS. 1 to 6 so as to be on top of an upright container. The filling head 50 comprises a sealing ring 51 which is pressed into sealing engagement with the cup 3 so as to surround the stem 9 and includes a filling duct 52 through which the pressurised fluid is delivered. The fluid delivered from the filling head 50 will generally be a propellant material for pressurising a product already partially filling the container. Alternatively in some applications it may be desirable to deliver the product itself via the filling head and where the product is to be pressurised within the container the pressurising gas may be delivered in saturated solution within the product.

The filling duct 52 is a loose fit around the stem 9 such that fluid passes around the stem into the annular gap 33 between the stem and the cup 3. The sealing gasket 32 surrounding the stem 9 of the pump assembly deforms under the applied pressure sufficiently to allow fluid to enter the cylinder 4. The stem 9 is depressed by a detent 53 extending radially into the filling duct 52 such that the piston 16 moves into a partially depressed position as described above with reference to FIG. 2 and a fluid pathway is then established from the filling duct 52, through the annular gap 33, into the first end 7 of the cylinder 4 and through the vent 29 into the container.

After a predetermined volume of fluid has been forced into the container the fluid pressure is relaxed and the sealing gasket 32 relaxes to its normal position as shown in FIG. 1. The filling head 50 is removed and the piston 16 then returns under action of the spring 17 to its rest position.

An alternative pump assembly 60 is shown in FIG. 8 in which components corresponding to those of pump assembly 1 are numbered with corresponding numerals where appropriate. The alternative pump assembly 60 is suited for use with an upright container (not shown) and is shown in FIG. 8 in its non inverted position ready for use.

In the rest position of the piston 16 the valve member 25 seals completely against the cylinder 4 so that in the rest position the cylinder is open only at its second end 24 by virtue of the secondary piston 18 projecting from the secondary cylinder 5.

A tubular extension 61 is provided at the remote end of the secondary cylinder 5 and a dip tube (not shown) is locatable within the tubular extension such that the tubular extension and the dip tube together form a conduit communicating between the secondary cylinder 5 and the bottom of the container (not shown) which would normally contain liquid in which the end of the dip tube was immersed. The pump action of the pump assembly 60 is similar to that of the pump assembly 1 described above except that the pump assembly 60 is not self priming. When used with a container in which a quantity of liquid partially fills the container with the remaining volume of the container being filled with a gas the pump assembly 60 will initially have both cylinder 4 and secondary cylinder 5 filled with the gas whilst the container is in the upright condition. Depression of the piston 16 will result in a quantity of gas being expelled from the cylinder 4 and on completion of the pump cycle (i.e. when the piston returns to its rest position) a partial vacuum formed in the cylinder 4 will be relieved by liquid being drawn through the dip tube and tubular extension 61. After a number of priming pump actions the cylinder 4 will become filled with liquid and subsequent pump actions will dispense the predetermined volume of liquid as required.

This alternative pump assembly is particularly useful with containers which are vented to air so that they necessarily must be used in an upright position. The assembly may alternatively be used with pressurised containers in which the pressurising gas may for example be Nitrogen, Carbon Dioxide, Nitrogen Dioxide or a fluorocarbon or hydrocarbon gas.

An alternative piston and valve member arrangement is shown in FIGS. 9 and 10 in which a piston 70 comprises first and second relatively moveable parts 71 and 72 respectively which are connected by a valve member 73 so as to be relatively moveable by deformation of the valve member. The first piston part 71 comprises a stem 9 similar to the stem of FIGS. 1 to 8 in that it extends through a sealing gasket 32 into the cylinder 4 and is retained by a flange 11. The first piston part 71 however is truncacted at the flange 11 and includes an annular rib 74 projecting into the cylinder 4 so as to retain the sleeve portion 26 of the valve member 73 in coaxial alignment with the first piston part 71.

The second piston part 72 is tubular and nestable within the valve member 73 and the first piston part 71. A radially extending flange 75 extends from the mid point of the second piston part in abutment with the piston ring portion 27 of the valve member 73. A forward end 76 of the second piston part 72 projects towards the secondary cylinder 5 and is held in abutment with the secondary piston 18 under action of the spring 17 such that the first and second piston parts are biassed together with the tubular valve member 73 being held in compression therebetween. This compression is insufficient to deform the valve member 73 which retains its tubular shape in the rest position of the piston 70 and during its initial stages of depression.

The forward end 76 is castellated to provide gaps 81 between the second piston part 76 and the secondary piston 18 when in mutual contact so that the interior of the second piston part 76 is in fluid communication with the cylinder 4.

When the piston 70 is depressed the depression is transmitted via the valve member 73 at the second piston part 72 so as to depress the secondary piston 18 and the travel continues until the flange 75 encounters an abutment 77 after a predetermined length of travel. Further depression of the piston 70 then results in deformation of the valve member 73 to uncover an aperture 78 in the outer cylindrical surface 80 of the second piston part 72 at which point a fluid flowpath is established from the cylinder 4 through the second piston part 72, the aperture 78 and into the stem 9 to be discharged therefrom under pressure provided by spring action against the secondary piston 18.

A further alternative pump assembly 90 is shown in FIG. 11 which shows a modified version of the pump assembly 1 of FIGS. 1 to 7. Components corresponding to those of pump assembly 1 are numbered with corresponding numerals where appropriate in FIG. 11. The main difference lies in the shape of the valve member 91 which has a sleeve portion 92 coaxially mounted on the stem 9 with a piston ring portion 93 projecting radially from the lower end 95 of the sleeve portion, the lower end being furthermost from the secondary piston 18 and adjacent to the sealing gasket 32. An annular flange 94 extends radially inwardly of the upper end 96 in sealing contact with the outer cylindrical surface 36 of the stem 9 so as to normally close the aperture 31.

The valve member 91 is located axially between a boss 97 of the stem and a stop 14 of the cylindrical member 30. Upon depression of the stem 9 the valve member moves with the piston 16 with the piston ring portion 93 of the valve member 91 in sliding contact with the cylinder 4. After the stem 9 has been depressed by a predetermined distance the flange 94 of the valve member 91 abuts with the webs 23 and continued depression deforms the valve member 91 axially so as to uncover the aperture 31 to thereby discharge the pump assembly 90. This arrangement is an improvement over the device shown in FIGS. 1 to 7 in that pressure and frictional forces acting on the piston ring portion 93 during depression of the stem 9 do not axially compress the sleeve portion 92 so that the valve member 91 cannot be inadvertently deformed by excessive friction or fluid pressure within the chamber 4 as might otherwise occur for instance when the stem 9 is depressed with excessive voilence.

A further alternative pump assembly 190 is shown in FIG. 12 which shows a modified version of the pump assembly 90 of FIG. 11. Components corresponding to those of pump assembly 90 are numbered with corresponding numerals where appropriate. The assembly 190 of FIG. 12 differs from the pump assembly 90 of FIG. 11 in that the selected dimensions of the cylinder 4 and the secondary cylinder 5 are such that their respective diameters differ only marginally. An annular insert 200 is therefore included within the cylinder 4 adjacent to its point of connection to the secondary cylinder 5 to thereby enhance the extent of the radially inward projection against which the upper end 96 of the valve member 91 abuts.

The annular insert 200 comprises a rigid washer of a plastics material which is received as a force fit within the cylinder 4.

The secondary piston 118 of FIG. 12 includes a rearward portion 119 of cruciform cross section which is of narrower diameter than the annular collar 22 and is located within the spring 17. The use of such a cruciform cross section has been found to improve the rigidity and dimensional reproducability of the moulded secondary piston 118.

Each of the above described pump assemblies may be used with an atomising nozzle (not shown) which fits upon the outer end of the stem 9 in known manner. In order to obtain satisfactory atomisation in those applications where such a nozzle is fitted the pressure of the dispensed fluid must be matched to the particular type of nozzle utilised. The pressure of the dispensed product is determined by the change in volume occuring within the variable volume fluid storage chamber during discharge and by the pressure applied to the fluid therein by the spring 17. Once a pump assembly has been constructed to the required dimensions some fine tuning of the dispensed pressure by the pump designer is possible by replacing the spring 17 with alternative springs of different strength.

Pump assemblies in accordance with the present invention may be used in dispensing metered doses of products for medical applications for example and may be used with pressurised or unpressurised containers. When it is required to use such a pump assembly with a vented container such that the container must be used in its upright condition then it is appropriate to use the pump assembly of the type disclosed with reference to FIG. 8 above which is not self priming. For other applications in which the container may be inverted the self priming type of pump assembly such as described above with reference to FIGS. 1 to 7 is appropriate.

I claim:

1. A pump assembly for an atomising piston pump comprising a piston slidably located in a cylinder, a variable volume fluid storage chamber in communication with the cylinder on one side of the piston, means for varying the volume of the chamber, resilient means urging the varying means into a position corresponding to the minimum volume of the chamber, a fluid flow passageway through the piston, a resilient valve member normally closing the passageway and deforming means for deforming the valve member so as to open the passageway only after the piston has moved relative to the cylinder by a predetermined amount greater than zero, the piston including a cylindrical surface in which an aperture of the passageway is formed, the resilient valve member including a sleeve portion which overlays the cylindrical surface where it normally obturates the aperture, the sleeve portion is axially compressible by the deforming means so as to at least partially uncover the aperture to open the passageway, the resilient valve member is movable with and mounted coaxially on the piston and further comprises a piston ring portion of larger radius than the sleeve portion, the piston ring portion forming a circumferentially complete seal between the piston and the cylinder throughout at least part of the piston stroke.

2. A pump assembly as claimed in claim 1 wherein the piston ring portion is located at or adjacent to a first axial extremity of the sleeve portion, the valve member being orientated such that a second axial extremity of the sleeve portion precedes the first extremity during the compression stroke of the piston into the cylinder.

3. A pump assembly as claimed in claim 2, the cylinder having a first end adjacent the piston in its position of rest between operating periods of the pump assembly and a second end adjacent the piston in its position of maximum travel during operation of the pump assembly, and wherein the cylinder is open at both first and second ends for filling with fluid whilst the piston is in its rest position.

4. A pump assembly as claimed in claim 3 wherein the cylinder includes a bypass channel at the first end which provides a flowpath bypassing the seal provided by the piston ring portion of the valve member when the piston is in its rest position whereby the cylinder is then open at its first end.

5. A pump assembly as claimed in claim 2 wherein the piston ring portion provides a seal between the piston and the cylinder throughout the stroke of the piston and wherein, in the rest position of the piston at the first end of the cylinder between operating period of the pump assembly, the cylinder is open at its second end for filling with fluid.

6. A pump assembly as claimed in claim 1 wherein the deforming means comprises abutment means extending inwardly of the cylinder and engageable in abutment with the valve member when the piston has moved by the predetermined amount such that continued piston movement deforms the valve member.

7. A pump assembly as claimed in claim 6 wherein the abutment means comprises an annular insert located in the cylinder so as to provide a radially inwardly directed projection for abutment with the valve member.

8. A pump assembly as claimed in claim 1 wherein the piston comprises an elongate body portion having a front end extending into the cylinder and a projecting portion which is connected coaxially therewith to the front end by means of the valve member so as to be longitudinally moveable relative to the body portion by deformation of the valve member, the cylinder having at its second end an abutment means engageable in abutment with the projecting portion when the piston has moved relative to the cylinder by the predetermined amount, which abutment means and projecting portion together constitute the valve member deforming means.

9. A pump assembly as claimed in claim 8 wherein the body portion is tubular and the projecting portion is tubular having a closed end adjacent to and nestable within the body portion, the projecting portion having a radially extending port having an aperture in its outer cylindrical surface which is normally closed by the valve member and opened by action of the deformation means to deform the valve member, the arrangement being such that when the aperture is open the projection portion, the port and the body portion define an open passageway through the piston and when the aperture is closed the passageway is closed by the valve member.

10. A pump assembly as claimed in claim 1 for use with a pressurised dispensing container and comprising means for admitting pressurised fluid to the container through the pump assembly.

11. A pump assembly as claimed in claim 10 wherein the fluid admitting means comprises a deformable sealing gasket normally in circumferential sealing contact with the stem of the pump assembly and being deformable under externally applied fluid pressure to admit fluid to the cylinder of the pump assembly, and there being provided a vent of the pump assembly communicating between the cylinder and the container for the admission of fluid thereto.

12. A pressurised dispensing container including a pump assembly as claimed in claim 1.

* * * * *